United States Patent [19]

Stockermann et al.

[11] Patent Number: 4,803,807

[45] Date of Patent: Feb. 14, 1989

[54] SAFETY DEVICE FOR A DOOR SYSTEM

[75] Inventors: Horst Stockermann, Sauerlach; Herman Bohm, Augsburg; Josef Grober, Munich; Wolfgang David, Donauworth, all of Fed. Rep. of Germany

[73] Assignee: Messerschmitt-Bölkow-Blohm GmbH, Munich, Fed. Rep. of Germany

[21] Appl. No.: 72,020

[22] Filed: Jul. 10, 1987

[30] Foreign Application Priority Data

Jul. 23, 1986 [DE] Fed. Rep. of Germany ..... 3624823

[51] Int. Cl.[4] ..... E05F 15/02

[52] U.S. Cl. ..... 49/26

[58] Field of Search ..... 49/26, 28

[56] References Cited

U.S. PATENT DOCUMENTS 3,276,164 10/1966 Hilfing et al. ..... 49/28

*Primary Examiner*—Philip C. Kannan

*Attorney, Agent, or Firm*—Kenyon & Kenyon

[57] ABSTRACT

To provide, for a sliding door with a pneumatically operated door panel servomotor, a safety device which operates independently of the usual reversing device and which limits the maximally active door closing force to an exactly settable value in a simple and reliable manner, there is associated with the servomotor, a limit value control circuit with a closing force sensor which senses the reaction force of the servomotor acting on the door jamb side during the closing process and a sensor-controlled three-position control valve which freely vents the closing pressure side of the servomotor above a given response value of the closing force sensor.

9 Claims, 1 Drawing Sheet

SAFETY DEVICE FOR A DOOR SYSTEM

BACKGROUND OF THE INVENTION

The present invention relates to a safety device for a door system.

Known door systems of this kind, and in particular automatic sliding or swinging-sliding doors of rail vehicles, buses, etc., which use for the drive of the door panel usually a pneumatic long-stroke piston-cylinder unit directly coupled therewith, operate, in order to obtain a sufficiently high closing speed, at a relatively high operating pressure and develop, when the door encounters an obstacle, accordingly strong closing forces in the order of magnitude of 1000 N. For safety reasons, the door controls of such door systems are therefore equipped with a reversing device including a contact or pressure strip extending over the closing edge of the door panel and an electric contact switch associated therewith which responds to the closing edge when a relatively strong squeezing pressure occurs and which then triggers an opening signal reversing the pneumatic drive. In this connection it has been found to be a problem, however, that such reversing devices are relatively trouble-prone in particular in the region of the contact or seal strip and thus offer limited protection in particular of persons against possible injury when the door closes.

SUMMARY OF THE INVENTION

It is an object of the present invention to provide a safety device for a door system which operates independently of the above described reversing device and is designed so that, while maintaining a high closing speed, the drive force of the servomotor acting on a person wedged in during the closing process or on another obstacle is limited in a simple, reliable and exactly adjustable manner to a permissible maximum value, and that, if necessary, the door panel can be pushed open manually without great exertion counter to the action of the servomotor.

The above and other objects of the invention are achieved by a safety device for a door system, in particular for an automatic sliding door of a vehicle, having a pressure medium operated door panel servomotor including a door control with an operating pressure supply line associated with the pressure side of the servomotor acting in a closing direction, wherein, in order to limit the closing force for the door panel there are provided a closing force sensor for resiliently sensing the drive force of the servomotor during the closing process, and a sensor-controlled control valve coupled thereto for conforming movement which freely vents in an unthrottled position the closing pressure side of the servomotor above a given response value of the closing force sensor.

With the safety device according to the invention, which operates in the manner of an internal force-limiting control circuit associated with the servomotor, it is ensured, even at a high operating pressure in the supply line as required for a large quantity of flow medium flowing to the closing pressure side and a correspondingly high closing speed of the servomotor, that the drive force of the servomotor remains limited to a maximum value adjustable at the sensor during the entire closing process, and this regardless of whether or not a reversing device is present and responds when an obstacle is encountered. The closing force limitation according to the invention, for which only few, simple and reliable structural elements are needed, is extremely trouble-free and operates without outside energy and with high precision because the control valve is actuated directly as a function of the drive force itself and not subject to the pressure level on the closing pressure side of the servomotor which would indicate the drive force only indirectly and relatively imprecisely. Due to the venting brought about by the control valve above the permissible limit value of the closing force and hence pressure reduction on the closing pressure side, the servomotor can, if necessary upon interruption of the closing process, be pushed over also manually by a substantially constant counter-force, also limited to the permissible maximum value, counter to the closing direction, so that by the safety device of the invention not only the risk of injury is minimized, but also even relatively weak persons can, if wedged in, free themselves without any great exertion by pushing the door panel open. In a case of actual use of the invention the closing force maximum was adjusted to about 1/10 the maximum drive force of the usual door systems, thus being in the order of magnitude of 100 N.

In a preferred embodiment, the closing force sensor is formed as a simple spring element, and instead of being located between the servomotor and door panel, it measures the reaction force of the servomotor acting at the jamb-side support and equal but opposite to the closing force, thereby achieving a considerable structural simplification and again clearly reducing the risk of failure, because no parts moving with the door panel are needed for the safety device. It is indeed readily possible to vary the permissible closing force maximum by adjusting the excursion of the spring element that corresponds to the venting position of the control valve, but for reasons of constant switching movements it is desirable to adjust the initial tension of the spring element for the purpose of varying the limit value of the closing force.

With a view to simple mechanical coupling between closing force sensor and control valve, by which there is achieved at the same time a limitedly movable connection of the servomotor at its jamb-side support, which is elastic due to the spring element, appropriately a rocker is associated with the servomotor, with the control valve and with the spring element. With a stop member, it is ensured that the drive force of the servomotor is absorbed through the spring element or the closing force sensor only during the closing process, not when opening the door.

With a view to a very sensitive closing force limitation, and in order to keep the pressure medium consumption low when the safety device responds, the control valve preferably is designed in an especially appropriate manner, as a three-position valve which in its inactive position, which it occupies below the set closing force limit value, opens the pressure supply line toward the closing pressure-side of the servomotor, in its middle position, that is, when the closing force is at the set limit value, closes the pressure supply line at first, and only in the other end position, that is, when the preset closing force limit value is exceeded, vents the closing pressure side of the servomotor—the supply line remaining closed—not completely, but only until by the resulting pressure reduction on the closing pressure side the drive force of the servomotor drops to the preset limit value again, whereupon the valve is again repositioned back to the middle position and, if the closing process can be continued unhindered, to the inactive position.

Preferably the safety device according to the invention is combined with an automatic door system which comprises as a servomotor a pneumatic long-stroke piston-cylinder unit active in the closing as well as in the opening direction, the piston rod of which is connected directly to the door panel, and the cylinder of which is supported on the jamb side by the closing force sensor or respectively the rocker cooperating with the spring element.

BRIEF DESCRIPTION OF THE DRAWINGS

The invention will now be explained more specifically with reference to an embodiment in conjunction with the drawings, in which.

DETAILED DESCRIPTION

Figure 1:
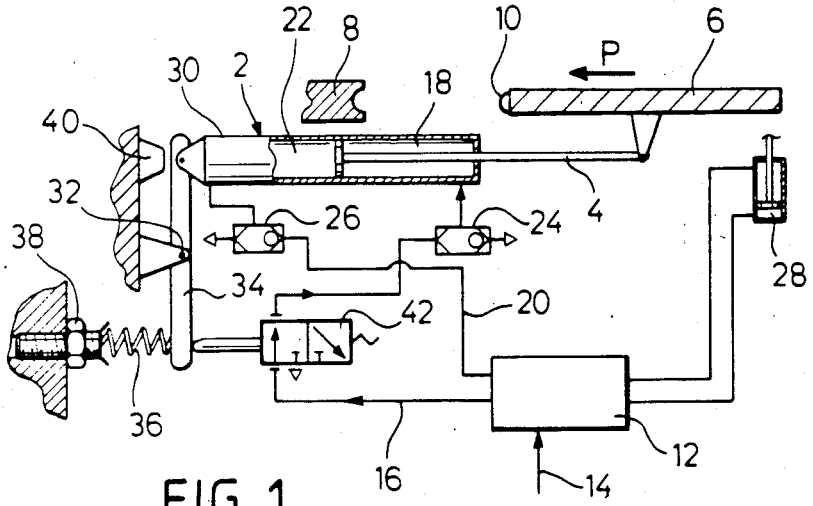
FIG. 1 shows schematically the safety device in the inactive state with associated door system during the closing process.

The automatic door system shown in the figures includes as a servomotor a double-action pneumatic long-stroke piston-cylinder unit 2, the piston rod 4 of which is connected directly to the sliding door panel 6, which during the closing process is moved by the servomotor 2 in arrow direction P onto the door post or jamb 8 and is opened in the opposite direction. The closing edge 10 of door panel 6 may be formed as a contact or pressure strip of a reversing device which is of no specific interest here and therefore will not be described further.

The control of the servomotor 2 occurs by a door control 12, which is connected to a compressed air line 14 of, e.g., 5 bars and which communicates via a closing air supply line 16 with the piston rod-side closing pressure chamber 18 and also via an air supply line 20 with the cylinder chamber 22 pressurized when door panel 6 opens. Contained in the supply lines 16 and 20 are automatic switching valves 24, 26 which vent the associated cylinder chamber 18, 22 to the outside as soon as the latter and the associated supply line have become pressureless, but which block the free communication of the cylinder chamber 18, 22 to the outside as soon as the supply line 16, 20 is pressurized and as long as the cylinder chamber 18, 22 is under pressure. In other words, the switching valves 24, 26 prevent that upon pressurization of the respective cylinder chamber 18 or 22 a counter-pressure can build up in the other cylinder chamber 22 or 18, respectively. The switching valves 24, 26 remain in the position shown during the entire closing process, hence also when the safety device described below responds, because by the safety device at best, a pressure reduction of the closing pressure chamber 18 is brought about, but the latter is not controlled to be completely pressureless. Associated with the door control 12 is further a pneumatic door lock 28. To this extent the door system shown is of the usual construction and mode of operation.

In order now to limit the maximally active door closing force to a variably adjustable value, which for the purpose of protection in particular of persons is chosen as low as is possible while keeping the door closing time sufficiently short, there is assigned to the servomotor 2 a safety device by which the supply and discharge of closing air to and from the closing pressure chamber 18 is regulated during the entire closing process in accordance with the effective drive force of the servomotor 2. For this purpose, the cylinder 30 of servomotor 2, instead of being directly supported on jamb 8, is mounted hinged at a rocker 34 pivoting about a fixed pivot 32, which rocker is braced at its free end against a spring element in the form of a compression spring 36, the initial tension of which is adjustable variably—for instance with the aid of the set screw 38 shown in the figures.

Therefore, the door closing force or respectively the equal but opposite reaction force of the servomotor 2 is transmitted from the cylinder 30 via the rocker 34 and the spring element 36 into the jamb 8, while upon pressurization of the cylinder chamber 22, that is, as the door opens, the reaction force of the cylinder 30 is absorbed through a stop 40 associated with the rocker 34.

The rocker 34 and the spring element 36, by which the servomotor 2 is elastically supported at the jamb 8 in the longitudinal direction, thus form a closing force sensor which picks up the drive force of the servomotor during the closing process and which is mechanically coupled to a control valve 42 contained in the closing air supply line 16. As long as the effective drive force of the servomotor 2 remains below the limit value set by the tension of spring 36, the control valve 42 is held by the rocker 34 in its inactive position (FIG. 1) in which it controls the supply line 16 open to the closing pressure side 18 of the servomotor 2.

Figure 2:
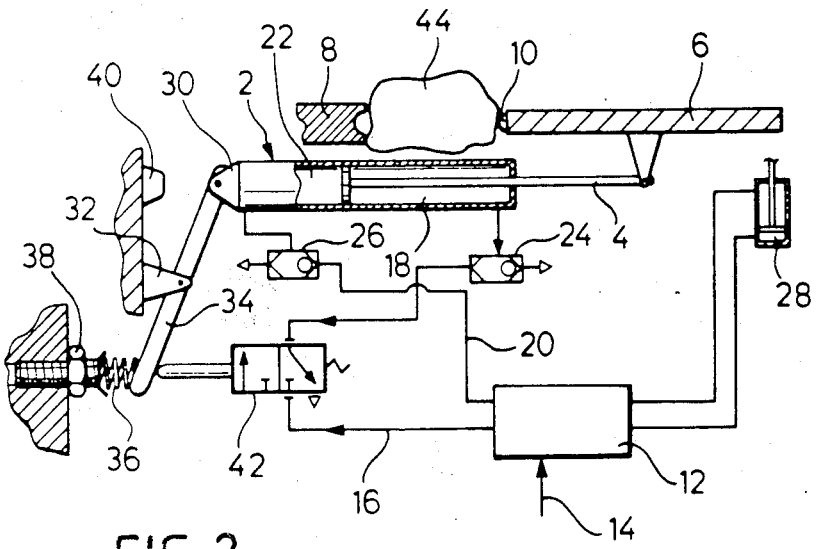
FIG. 2 shows, in a view similar to FIG. 1, but with a safety device activated for the purpose of closing force limitation, after the door panel impinges on an obstacle.

As soon as the door panel 6 runs against an obstacle 44 (FIG. 2) during the closing process, however, and the closing force of the servomotor 2 reaches the preset limit value, the closing force sensor responds, i.e. the rocker 34 is pivoted by the reaction force of servomotor 2 counter to the spring force of the compression spring 36, and control valve 42 is moved. It comes at first into an intermediate position, in which it closes the closing pressure side 18 of servomotor 2 off from the closing air supply line 16, and then into the venting position shown in FIG. 2, in which, with the supply line 16 remaining closed, compressed air escapes from the closing pressure side 18 of servomotor 2 into the open, until by the resultant pressure reduction on the closing pressure side 18 the drive force of servomotor 2 is reduced to the extent that the rocker 34 and via it the cylinder 30 are reset under the compressive force of spring element 36 and the control valve 42 is again repositioned to the intermediate position and—upon elimination of the obstacle 44—to the inactive position, whereupon the closing process is continued automatically under the control of the door control 12.

The described safety device permits also, upon interruption of the closing process, the freeing of the wedged-in obstacle, and in particular a passenger, without any great exertion, by pushing the door panel 6 open counter to the closing force of servomotor 2. In fact, if a counter-force which exceeds the maximum set at spring 36 is exerted on the door panel 6 counter to the closing direction, the safety device also responds, so that the closing pressure chamber 18 is vented via the control valve 42 in such a way that the door panel 6 can be pushed open counter to a substantially constant resistance force of servomotor 2 limited to the set maximum.

In a case of actual use the maximum door closing force was limited to 100 N. The pressure level in the closing pressure chamber 18 of servomotor 2 associated with this closing force limit cannot be established exactly because it depends not only on the effective piston pressure surface but also on interfering parameters, as for instance the internal friction of the servomotor 2.

In the foregoing specification, the invention has been described with reference to an exemplary embodiment thereof. It will, however, be evident that various modifications and changes may be made thereunto without departing from the broader spirit and scope of the invention as set forth in the appended claims. The specification and drawings are, accordingly, to be regarded in an illustrative rather than in a restrictive sense.

What is claimed is:

1. A safety device for a door system, in particular for an automatic sliding door of a vehicle, having a pressure medium-operated servomotor for providing an opening force and a closing force to the door panel, and further including a door control with an operating pressure supply line associated with the pressure side of the servomotor acting in a closing direction of the door panel, and further comprising, in order to limit the closing force for the door panel, closing force sensor means for resiliently sensing the drive force of the servomotor during the closing process, and control valve means coupled to the means and moving therewith for automatically venting unthrottled the closing pressure side of the servomotor above a given response value of the closing force sensor means.

2. The safety device recited in claim 1, wherein the closing force sensor means further comprises spring means for supporting the servomotor against a fixed support.

3. The safety device recited in claim 2, further comprising means for adjusting the force supplied by the spring means to the servomotor, thereby adjusting the given response value of the closing force tensing means.

4. The safety device recited in claim 2, wherein the servomotor is supported on the fixed support limitedly movable by rocker means pivotably mounted about a fixed pivot point, said rocker means being pivoted counter to the force of the spring element in the direction of the reaction force of the servomotor acting during the closing process of the door panel, said rocker means being coupled to the control valve means for progressively actuating said control valve means.

5. The safety device recited in claim 4, further comprising stop means for limiting the pivoting movement of the rocker means in the direction of the reaction force of the servomotor acting during the opening of the door panel.

6. The safety device recited in claim 1, wherein the control valve means comprises slide valve means disposed in the closing pressure supply line of the servomotor, and which at first blocks the supply line when being moved to the venting position, and thereafter permits free outflow of pressure medium from the closing pressure side of the servomotor.

7. The safety device recited in claim 1, wherein the servomotor comprises a double-action pneumatic long-stroke piston-cylinder unit having a piston rod connected to the door panel and a main cylinder coupled to the fixed support through the closing force sensor means.

8. A safety device for a door system, in particular for an automatic sliding door of a vehicle, having a pressure medium-operated servomotor for providing an opening force and a closing force to the door panel, and further including a door control with an operating pressure supply line associated with the pressure side of the servomotor acting in a closing direction of the door panel, and further comprising, in order to limit the closing force for the door panel, closing force sensor means for resiliently sensing the drive force of the servomotor during the closing process, said closing force sensor means comprising spring means for supporting the servomotor against a fixed support, and control valve means coupled to the sensor means and moving therewith for venting unthrottled the closing pressure side of the servomotor above a given response value of the closing force sensor means.

9. A safety device for a door system, in particular for an automatic sliding door of a vehicle, having a pressure medium-operated servomotor for providing an opening force and a closing force to the door panel, and further including a door control with an operating pressure supply line associated with the pressure side of the servomotor acting in a closing direction of the door panel, and further comprising, in order to limit the closing force for the door panel, closing force sensor means for resiliently sensing the drive force of the servomotor during the closing process, and control valve means coupled to the sensor means and moving therewith for venting unthrottled the closing pressure side of the servomotor above a given response value of the closing force sensor means, said servomotor further comprising a double-action pneumatic long-stroke piston-cylinder unit having a piston rod connected to the door panel and a main cylinder coupled to the fixed support through the closing force sensor means.

* * * * *